US006528933B1

(12) United States Patent
Reyal

(10) Patent No.: US 6,528,933 B1
(45) Date of Patent: Mar. 4, 2003

(54) SHADOW MASK SUPPORT FRAME FOR A CATHODE-RAY DISPLAY TUBE

(75) Inventor: Jean-Pierre Reyal, Eragny (FR)

(73) Assignee: Imphy Ugine Precision, Puteaux (FR)

( * ) Notice: Subject to any disclaimer, the term of this patent is extended or adjusted under 35 U.S.C. 154(b) by 0 days.

(21) Appl. No.: 09/510,243

(22) Filed: Feb. 22, 2000

(30) Foreign Application Priority Data

Feb. 22, 1999 (FR) ..... 99 02129

(51) Int. Cl.[7] ..... H01J 29/80
(52) U.S. Cl. ..... 313/407; 313/402
(58) Field of Search ..... 313/402, 407

(56) References Cited

U.S. PATENT DOCUMENTS

| | | | | | |
|---|---|---|---|---|---|
| 4,804,881 | A | * | 2/1989 | Strauss | 313/407 |
| 5,053,674 | A | * | 10/1991 | Gismondo et al. | 313/407 |
| 5,336,964 | A | * | 8/1994 | Capek et al. | 313/407 |
| 5,550,428 | A | * | 8/1996 | Kume et al. | 313/407 |
| 5,698,938 | A | * | 12/1997 | Kim et al. | 313/407 |
| 5,898,259 | A | * | 4/1999 | Reyal | 313/407 |
| 5,917,274 | A | * | 6/1999 | Youn et al. | 313/407 |
| 6,054,803 | A | * | 4/2000 | Saita | 313/402 |

FOREIGN PATENT DOCUMENTS

| | | |
|---|---|---|
| EP | 0 709 872 | 5/1996 |
| EP | 0 788 133 | 8/1997 |
| EP | 0 809 272 | 11/1997 |
| WO | WO 95/30998 | 11/1995 |

* cited by examiner

*Primary Examiner*—Sandra O'Shea
*Assistant Examiner*—Jacob Y. Choi
(74) *Attorney, Agent, or Firm*—Oblon, Spivak, McClelland, Maier & Neustadt, P.C.

(57) ABSTRACT

A shadow mask support frame for a cathode-ray color display tube of generally rectangular shape in top plan view. The shadow mask support frame includes two end upstands, which are located opposite each other and which are intended to support a shadow mask, and two lateral upstands, which are intended to keep the end upstands apart or separated from each other. The end upstands and the lateral upstands are of generally tubular shape and constitute an almost continuous closed hollow body containing at least one plane closed line located entirely inside the hollow body and passing inside each of the end and lateral upstands. It may be produced by folding a single metal strip or by fitting two drawn shells together.

53 Claims, 11 Drawing Sheets

SHADOW MASK SUPPORT FRAME FOR A CATHODE-RAY DISPLAY TUBE

CROSS-REFERENCE TO RELATED APPLICATIONS

This application is related to and claims priority, under 35 U.S.C. §119, from French Patent Application No. 99 02129, filed on Feb. 22, 1999, the entire contents of which are hereby incorporated by reference herein.

BACKGROUND OF THE INVENTION

1. Field of the Invention

The present invention generally relates to a shadow mask support frame and more particularly, to a shadow mask support frame for a cathode-ray color display tube, which is both lightweight and rigid and easy to manufacture.

2. Discussion of Background

Cathode-ray color display tubes include a metal sheet pierced with a multitude of holes or slits, called "shadow mask", placed between the electron gun and the display screen. This shadow mask is intended to obtain a very sharp image by ensuring that the impacts of the electron beams on the display screen are located precisely on the phosphors placed on the display screen.

The shadow masks are supported by frames of generally rectangular shape which hold them in position near the display screen and, optionally, ensure that they are tensioned so as to limit any deformation resulting from local heating generated by the electron beams.

According to a known technique, a shadow mask support frame has two lateral upstands, consisting of metal tubes or of angle sections, and two end upstands, consisting of angle sections or of tubes placed on the lateral upstands and joined together by welding at the points of contact. Given the method of construction, the tubes or angle sections must be relatively thick in order to obtain sufficient stiffness. The frames thus formed are suitable for tensioned shadow masks, but have the drawback of being heavy and difficult to manufacture with good geometrical precision.

According to another known technique, a shadow mask frame consists of angle sections produced from thin strips shaped so as to form angle sections which are joined together by welding. In a variation, the frame is produced by drawing a generally rectangular metal sheet having a central cut-out, which is also rectangular. The frames, produced as above-described, have the advantage of being lightweight, but have the disadvantage of not being very rigid and consequently, are poorly suited to supporting tensioned shadow masks.

In order to improve the stiffness of lightweight frames, it has been proposed, especially in French Patent Application Publication No. 2,749,104, to manufacture such frames from two thin metal strips placed against each other and to have vertical and horizontal stiffening ribs. These frames are both lightweight and rigid, allowing them to be used for tensioned shadow masks, but they have the drawback of sometimes being difficult to manufacture.

SUMMARY OF THE INVENTION

The object of the present invention is to remedy the above-stated drawbacks by providing a shadow mask support frame which is both lightweight and rigid and easy to manufacture.

For this purpose, the subject of the present invention is a shadow mask support frame for a cathode-ray color display tube, of generally rectangular shape, comprising two end upstands, lying opposite each other and intended to house a shadow mask, and two lateral upstands, intended to keep the end upstands apart. The end upstands and the lateral upstands are of generally tubular shape and constitute an almost continuous closed hollow body containing at least one plane closed line located entirely inside the hollow body and passing inside each of the end and lateral upstands. This frame consists of at least one thin metal membrane.

The frame may, for example, consist of two thin metal membranes drawn so as to form an external shell and an internal shell, the two shells being fitted, one in the other, so as to form a hollow body.

The two shells may be made either of the same material or of two different materials.

The frame may also consist either of a single metal membrane folded so as to form a hollow body, or of several metal membranes folded so that each forms a hollow body constituting a frame portion, the frame portions then being joined together.

The end upstands, intended to house a shadow mask, may have a generally triangular cross section and include a flap along the upper arris, to which flap the edge of a shadow mask may be welded. They may also have a generally trapezoidal cross section so as to have an upper arris wide enough to allow welding of an edge of a shadow mask. The upper arris may be rectilinear or curvilinear.

The lateral upstands may have a cross section of any shape, and in particular a rectangular shape, or preferably a trapezoidal shape.

The frame may more particularly be intended to house a tensioned shadow mask.

The metal membrane or membranes of which the frame is composed are made of a metallic material taken, preferably, from the following materials: low-carbon steels, iron-based alloys, iron-nickel alloys, iron-chromium alloys, nickel-based alloys, structural-hardening alloys, martensitic-type hardening alloys, magnetic alloys, non-magnetic alloys and vibration-damping alloys. When the frame is made of several materials, these may be chosen, for example, so that the thermal expansion coefficient of the lateral upstands is different from the thermal expansion coefficient of the end upstands.

The invention also relates to a process for manufacturing a frame, in which a strip having the developed shape of the frame or of the frame portion or a plurality of strips having the developed shape of a plurality of complementary frame portions is cut from a sheet of metallic material, the strip or strips are folded along a plurality of lines so as to form the frame or the frame portions and, when the frame is made from a single piece, the edges of the strip which are superimposed one with respect to the other are fastened together by welding, brazing or clinching. When the frame is made from several pieces, for each of the frame portions, the edges of the strip which are superimposed one with respect to the other are fastened together by welding, brazing or clinching, and the frame portions are joined together by fastening them together by welding, brazing or clinching.

Preferably, the welding is laser welding or electron-beam welding. The shadow mask support frames, obtained by either laser or electron-beam welding, are both very rigid and very lightweight. Furthermore, they are easy to manufacture with a very high geometrical precision. In addition, they exhibit very good vibration behavior and in particular, significant damping.

BRIEF DESCRIPTION OF THE DRAWING FIGURES

Figure 7:
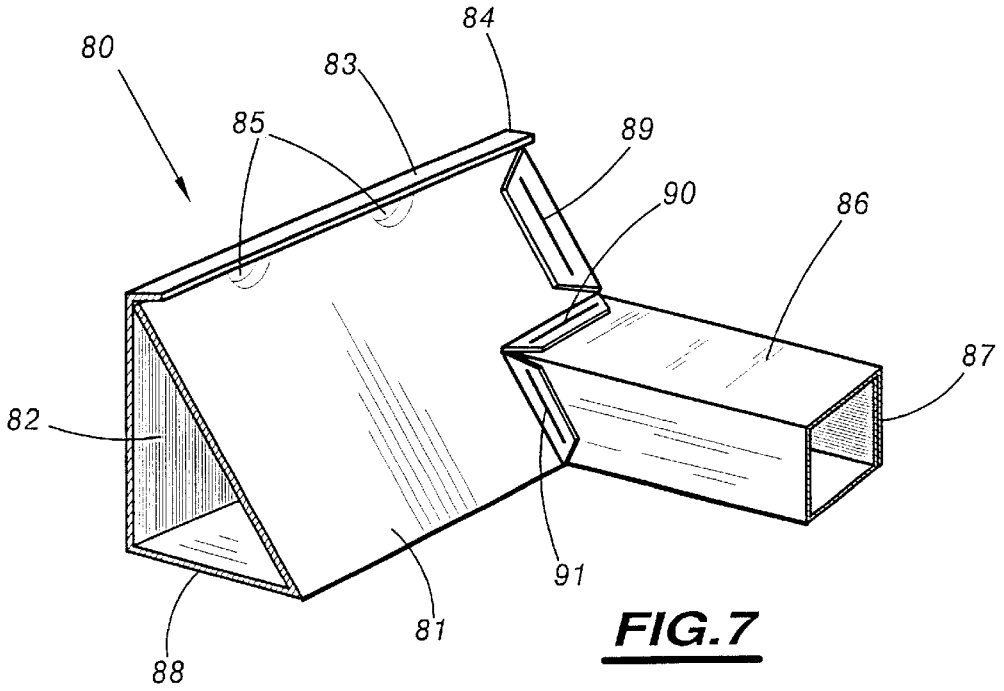
FIG. 7 is a perspective view of yet another embodiment of a shadow mask support frame consisting of a single folded metal strip having indentures along the upper arris of an end upstand.
Figure 8:
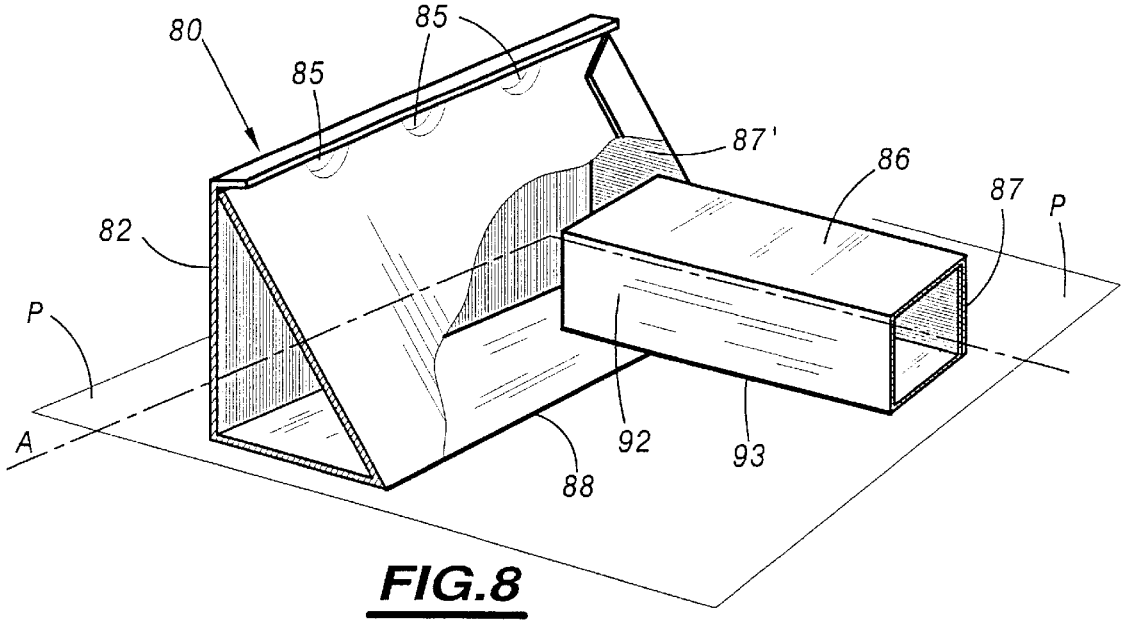
Figure 9A:
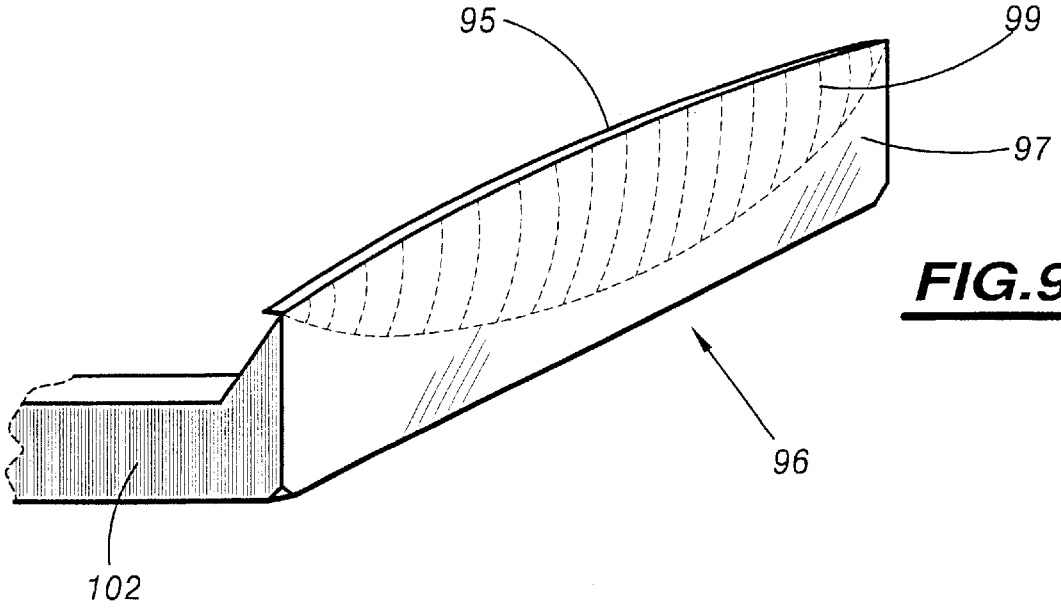
Figure 9B:
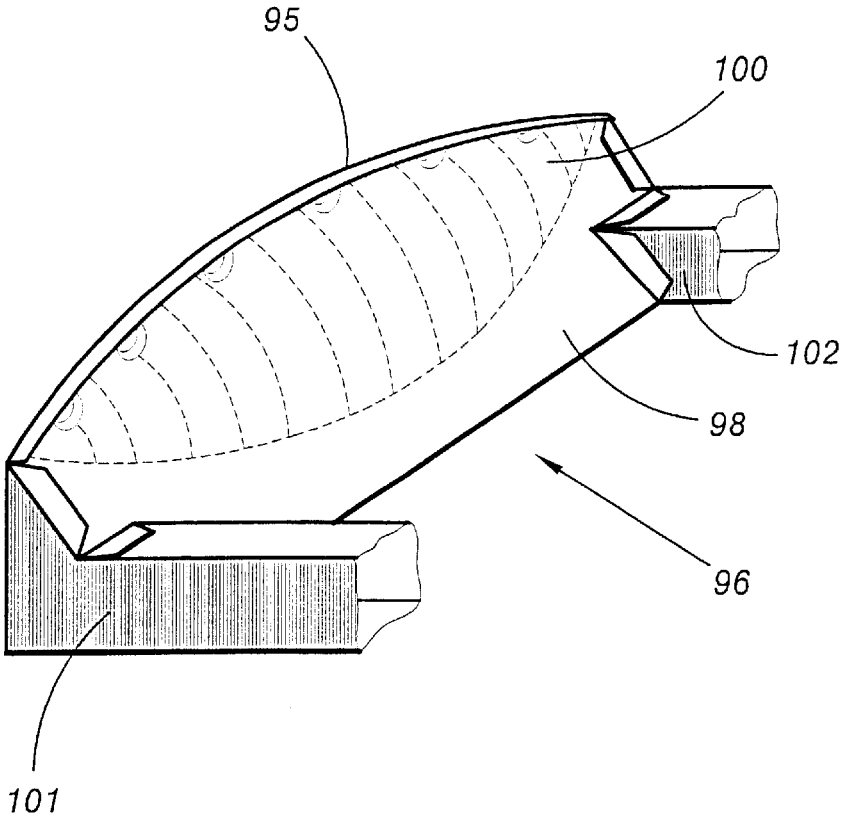
Figure 10:
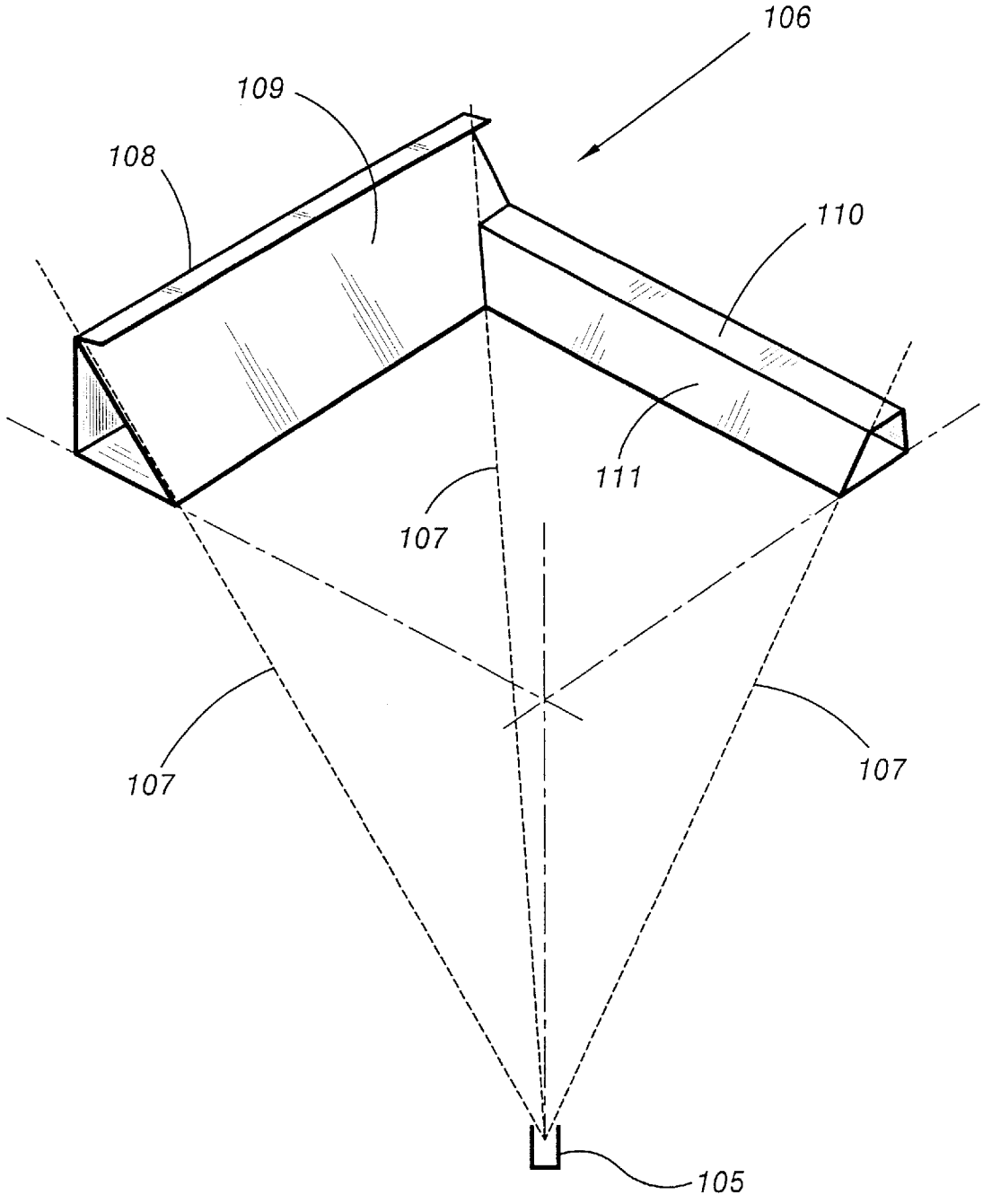
Figure 11:
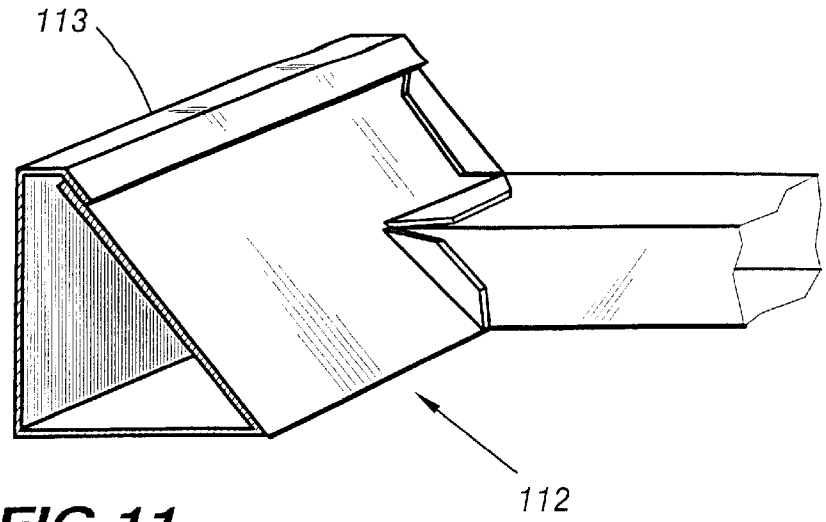
Figure 13A:
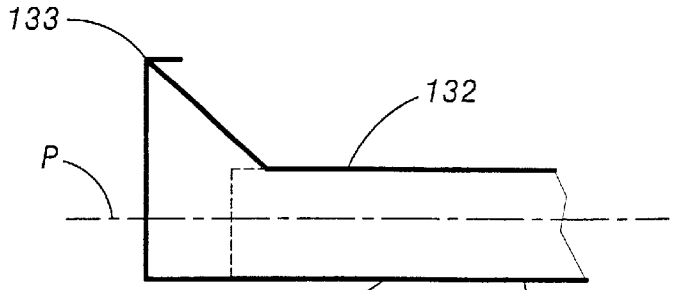
Figure 13B:
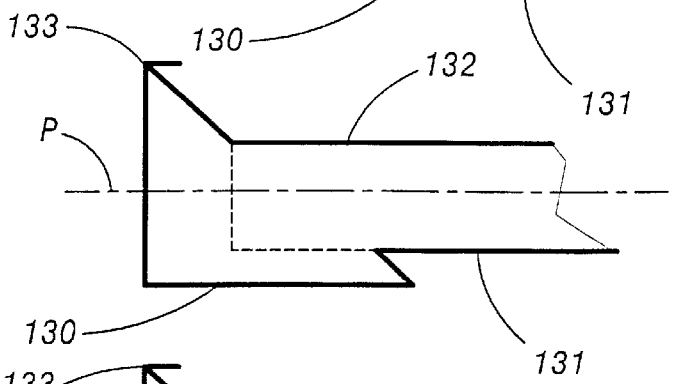
Figure 13C:
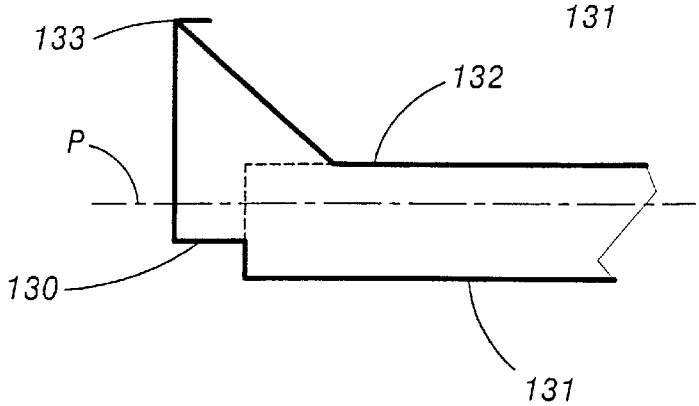
Figure 12A:
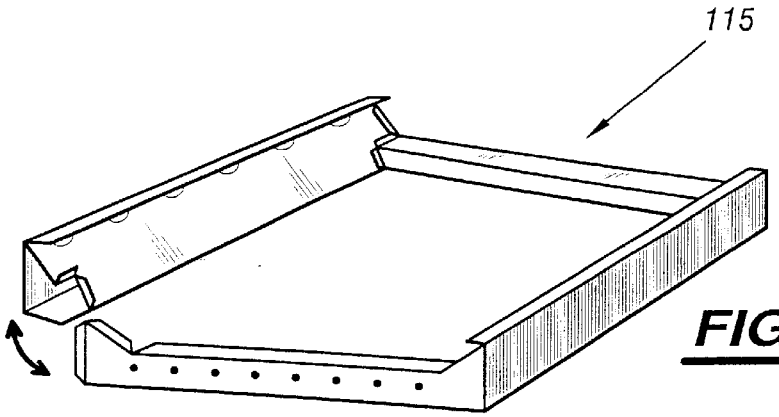
Figure 12B:
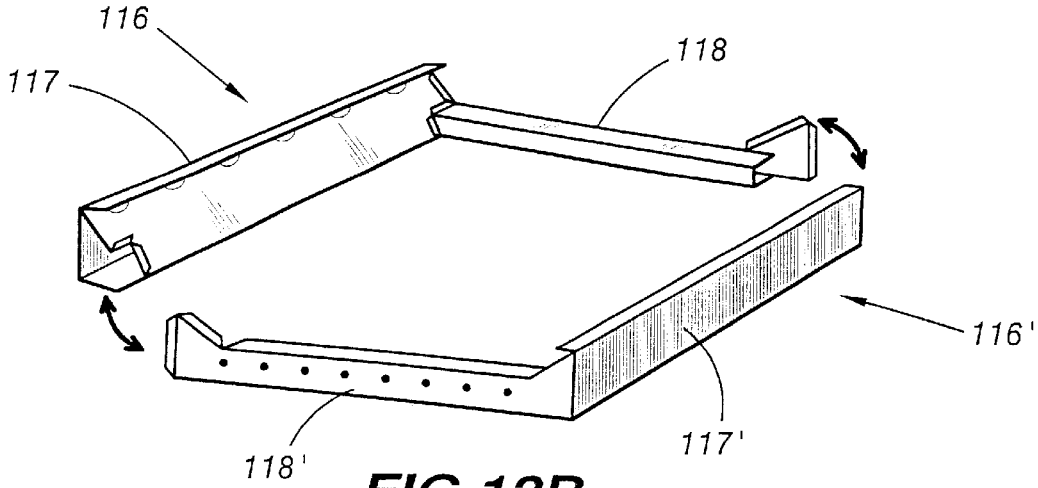
Figure 12C:
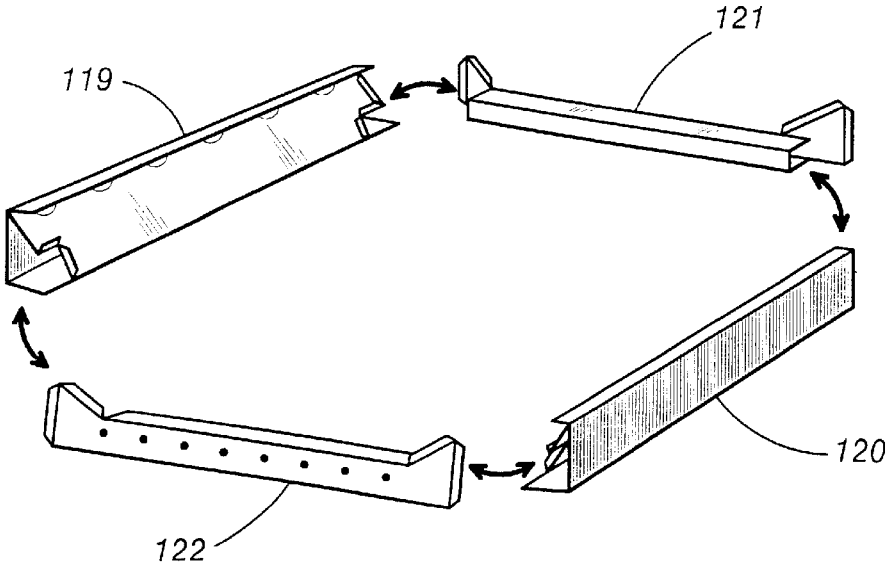
Figure 14:
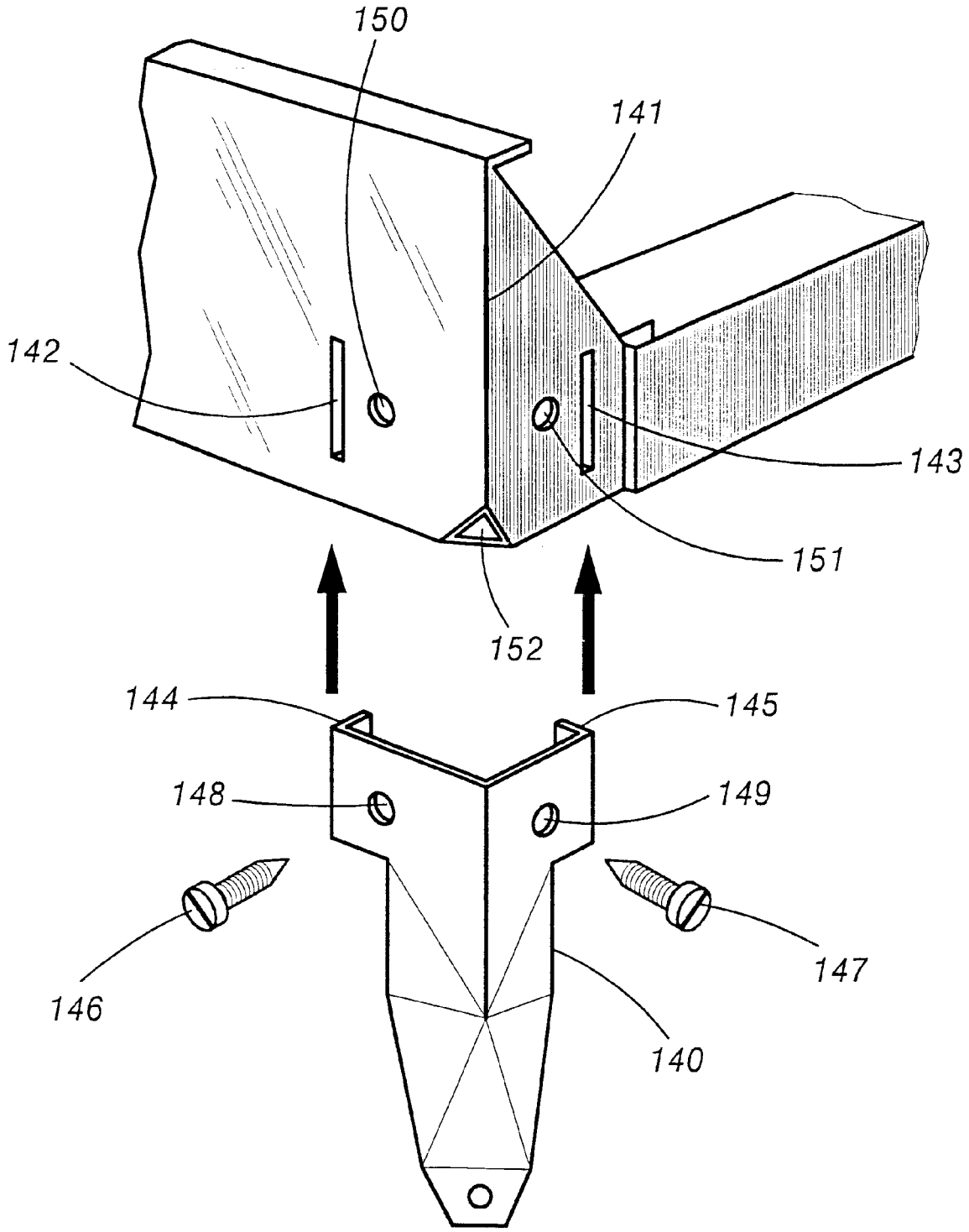
Figure 15:
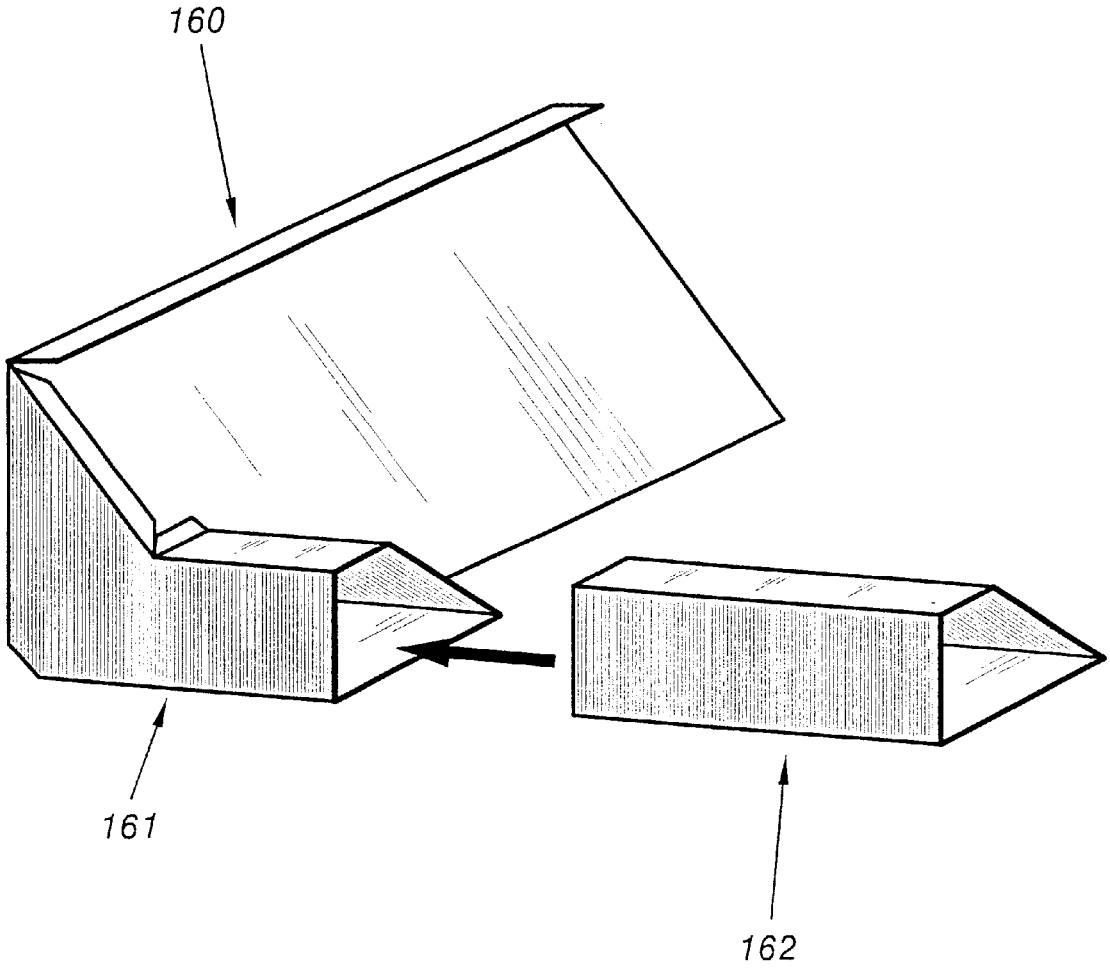

FIG. 8 the same embodiment of the shadow mask support frame as shown in FIG. 7, but with a partial cut-away of the wall;

FIGS. 9*a* and 9*b* are front and back perspective views, respectively, of yet another embodiment of a shadow mask support frame having an end upstand whose upper arris is curvilinear;

FIG. 10 is a partial schematic perspective view showing a quarter of the field scanned by an electron beam emitted by an electron gun and passing through a shadow mask support frame;

FIG. 11 is a perspective view of yet another embodiment of a shadow mask support frame, wherein an end upstand has a trapezoidal cross-section;

FIGS. 12*a,* 12*b,* and 12*c* are schematic perspective views of yet other embodiments shadow mask support frames made from one piece, two pieces, and four pieces, respectively, of metal strips;

FIGS. 13*a,* 13*b,* and 13*c* are schematic side views of three ways of connecting a lateral upstand to an end upstand of a shadow mask support frame;

FIG. 14 is an exploded perspective view of one corner of a shadow mask support frame and a fastener for fixing the frame in a cathode-ray tube; and FIG. 15 is a perspective view showing a quarter of a four-piece shadow mask support frame.

DETAILED DESCRIPTION OF THE PREFERRED EMBODIMENTS

Figure 1:
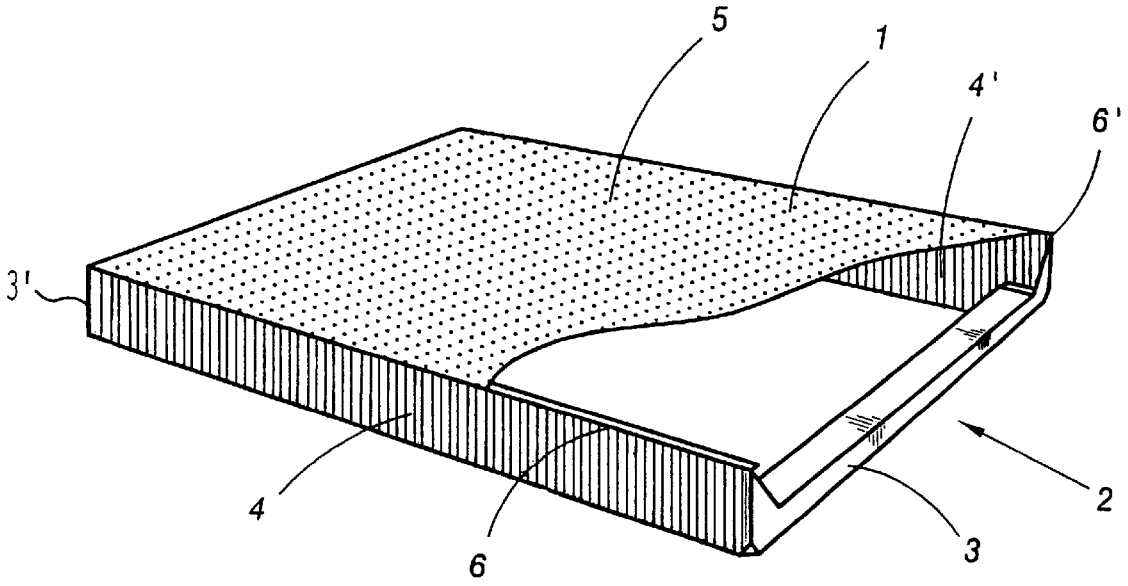
FIG. 1 is a schematic perspective view of a shadow mask support frame on which a partially cut-away shadow mask is supported.

FIG. 1 shows schematically a shadow mask 1 mounted on a shadow mask support frame 2. The shadow mask support frame 2 has a generally rectangular shape in top plan view and comprises two lateral upstands 3, 3' and two end upstands 4, 4'. The shadow mask 1 consists of a thin metal sheet, for example, mad of an iron-nickel alloy having a low expansion coefficient, pierced by a plurality of holes 5 and fixed by welding to the rims 6, 6' of the end upstands 4, 4'. Various shapes of the shadow mask are possible, and these shapes are well known to those skilled in the are. In the particular case shown in FIG. 1, the shadow mask 1 has a shape in the form of a portion of a cylinder, but the shadow mask 1 may also be planar. The shadow mask 1 may be tensioned, that is to say, subjected to tension parallel to the lateral upstands 3 of the shadow mask support frame 2 (only one lateral upstand being visible in the figure due to the partial cut-away of the shadow mask 1). In order to tension the shadow mask 1, two opposed forces are applied to the end upstands 4, 4' so as to move these end upstands 4, 4' slightly closer together, by elastic deformation and then, the shadow mask 1 is welded to the rims 6, 6' and the forces exerted on the end upstands 4, 4' is released.

The shadow mask support frame, which has just been described in a general way, may be placed on a horizontal plane surface, or reference plane, the shadow mask then being above the horizontal plane surface. This makes it possible to define, for each component of the frame, an upper arris or face located nearest the reference plane and an upper arris or face located further from the reference plane. When a shadow mask support frame is mounted in a cathode-ray tube, the upper arrises or faces defined above are located on the same side as the screen and the lower arrises or faces are located on the opposite side (on the same side as the electron gun). In order to make the description easier to understand, it will be assumed below that the shadow mask support frame is placed on a horizontal reference plane.

The tensioned shadow mask support frame, according to the present invention, comprises lateral and longitudinal upstands which have a generally tubular shape and form an almost continuous hollow body. The expression "almost continuous hollow body" should be understood to mean a hollow body whose internal part may be locally obstructed. The lateral and end upstands are placed in such a way that is it possible to trace a closed plane line entirely contained in the hollow body and passing inside each of the upstands. It is this structure which gives the frame, according to the present invention, its rigidity, especially because the forces are transmitted from an end upstand to a lateral upstand along a line located inside the lateral upstand. Several embodiments are possible. A few of these will be described by way of example.

Figure 2:
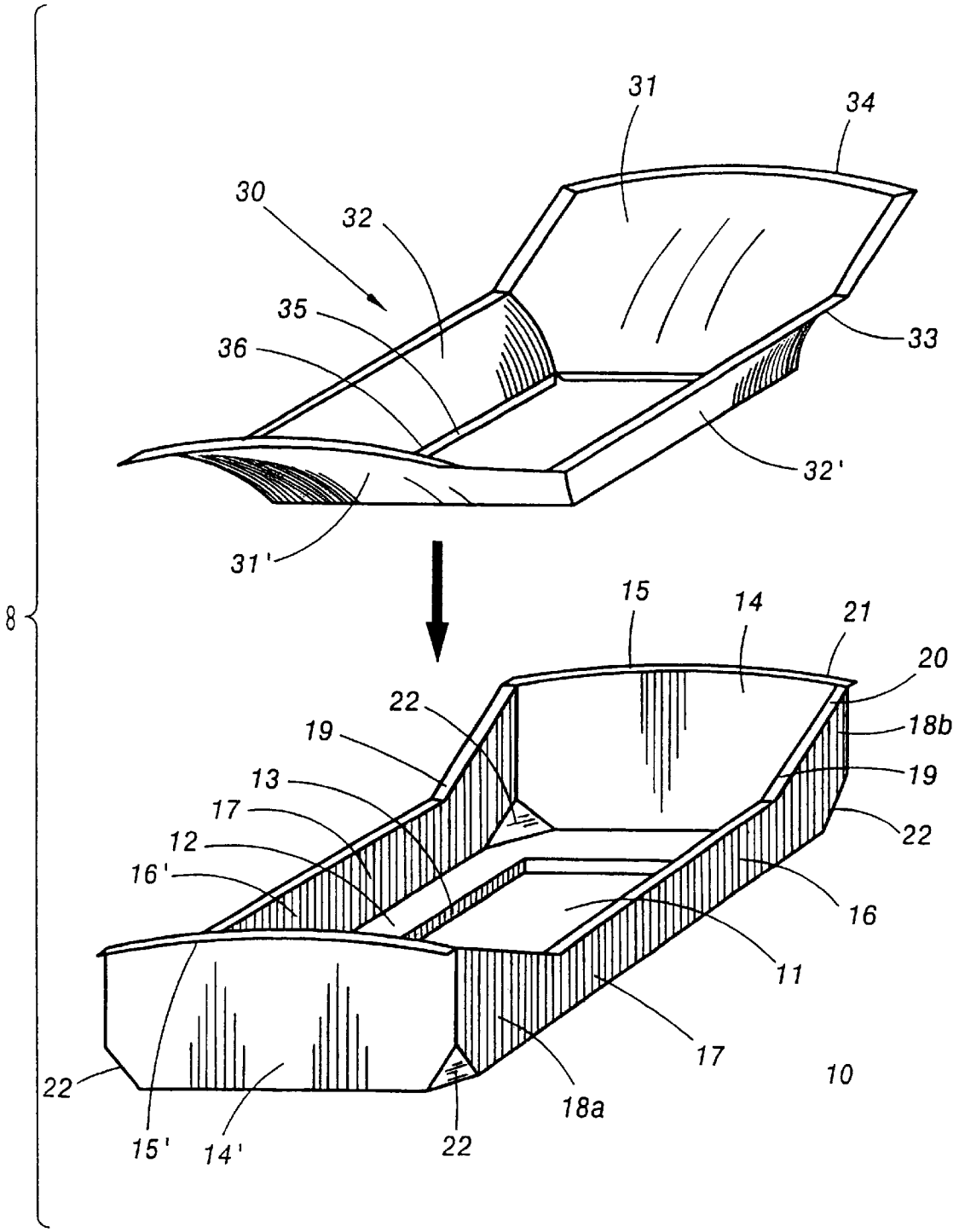
FIG. 2 is an exploded perspective view showing internal and external shells intended to be fitted together in order to form another embodiment of a shadow mask support frame.

In a first embodiment as shown in FIG. 2, the shadow mask support frame 8 consists of an external shell 10 and an internal shell 30 fitted together, one in the other, so as to form a continuous hollow body. The external and internals shells 10, 30 are obtained by drawing metal blanks of generally rectangular shape, having a central rectangular cut-out. Each of the external and internals shells 10, 30 form a metal membrane.

The external shell 10 has the shape of a rectangular box, comprising end walls 14, 14', side walls 16, 16', and a bottom open by a wide rectangular cut-out 11 leaving only a strip 12 extending all around the inner periphery of the external shell 10. The edge of the strip 12 defining the rectangular cut-out 11 is bent backwardly and upwardly so as to form a border. Each end wall 14, 14' has a circularly arcuate upper end 15, 15'. Each side wall 16, 16' includes an indent 19 so that the height of its central part 17 is less than the height of its ends 18*a,* 18*b*. The upper edges of the end walls 14, 14' and side walls 16, 16' form a continuous arris 20 having a flap 21 oriented towards the outside of the external shell 10. In a variation, these flaps 21 may be oriented towards the inside of the external shell 10. The corners 22 are cut so as to have a triangular inclined surface which can be used for fixing means for suspending the frame inside a cathode-ray tube.

The internal shell 30, having a shape complementary to that of the external shell 10, is a complex surface comprising two end faces 31, 31' roughly plane and inclined towards each other, and two cylindrical lateral faces 32, 32'. This surface is bounded, on the one hand, by an outer arris 33, having a rim 34 oriented towards the outside, the shape and dimensions of which are identical to those of the upper arris 20 of the external shell 10, and, on the other hand, by an inner arris 35, having a rim 36 oriented towards the inside and being of identical shape and size to those of the rectangular cutout 11 in the bottom of the external shell 10.

The shadow mask support frame is obtained by fitting the internal shell 30 into the external shell 10 in such a way that:

- the outer border 33 of the internal shell 30 engages with the upper border 20 of the external shell 10;
- the inner border 36 of the internal shell 30 engages with the strip 12 of the external shell 10, the border 13 of the strip 15 being fitted into the opening defined by the inner border 36 of the internal shell 30.

The two shells are fastened together along their rims by welding, by brazing or by clinching.

The two shells thus fitted together form a continuous hollow body having a generally rectangular shape and a flat bottom, so that the lateral and end upstands lie in the same plane. This structure has the advantage of being both very rigid and very lightweight and of having a very good geometrical precision. The rigidity is high enough for the shadow mask support frame to be able to be made of two shells whose thickness may vary, depending on the size of the cathode-ray tube and the type of alloy used, between 200 $\mu$m and 1500 $\mu$m and for it to be able to be used as a support frame for a tensioned shadow mask.

Other shapes may be produced, in particular the edges may all be rectilinear, the side walls of the lower shell may include stiffening ribs and the surfaces of the upper shell may be more or less plane or somewhat domed.

The two shells are made of a metallic material such as a low-carbon steel, an iron-based alloy, an iron-nickel alloy, an iron-chromium alloy, a nickel-based alloy, a structural-hardening alloy, a martensitic-type hardening alloy, a magnetic alloy, a non-magnetic alloy or a vibration-damping alloy.

The two shells may be made of the same material or of two different materials having, for example, different expansion coefficients.

Each shell may be made of two different materials, one forming the lateral upstands and the other the end upstands of the shadow mask support frame. To do this, each shell is produced from a composite blank obtained by butt-welding strips made of alloys of different nature. When the frame is intended to support a tensioned shadow mask, the materials may be chosen so that the thermal expansion coefficient of the lateral upstands is different from the thermal expansion coefficient of the end upstands, thereby making it possible to ensure that, in the end, the tension in the shadow mask is hardly affected by the temperature variations during manufacture of the cathode-ray tube.

In a second embodiment, the shadow mask support frame consists of a continuous, or almost continuous, rectangular hollow body obtained by folding a suitably cut metal strip. The metal strip, cut beforehand as will be described in greater detail below, is folded so as to form upstands of generally tubular shape, being connected in such a way that it is possible to trace inside the hollow body a closed plane line passing inside each upstand. The shadow mask support frame then consists of a single metal membrane.

Figure 3:
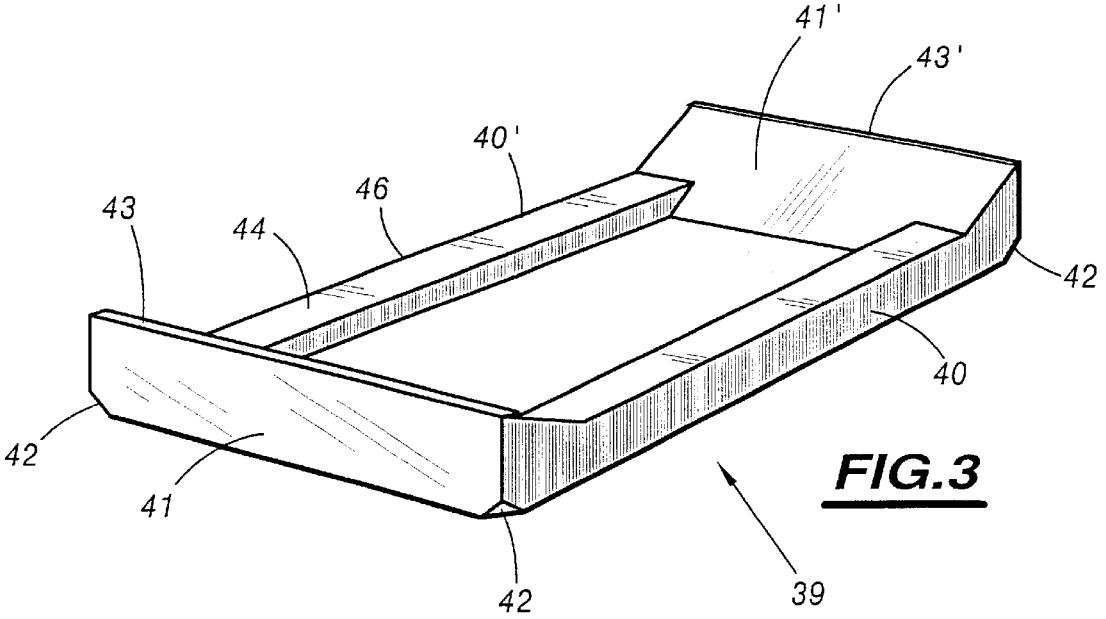
FIG. 3 is a perspective view of yet another embodiment of a shadow mask support frame consisting of a single folded metal strip.

The shadow mask support frame 39 (FIG. 3) comprises two lateral upstands 40, 40' of rectangular cross section and two end upstands 41, 41' of triangular cross section. The lateral upstands 40, 40' are shorter than the end upstands 41, 41' so that the arrises 43, 43', of the end upstands 41, 41', intended to house the shadow mask (not shown) project therefrom.

The lower corners 42, at the junction between a lateral upstand and an end upstand, are cut so as to have inclined plane surfaces able to house means for fixing the shadow mask support frame in the cathode-ray tube.

Figure 4:
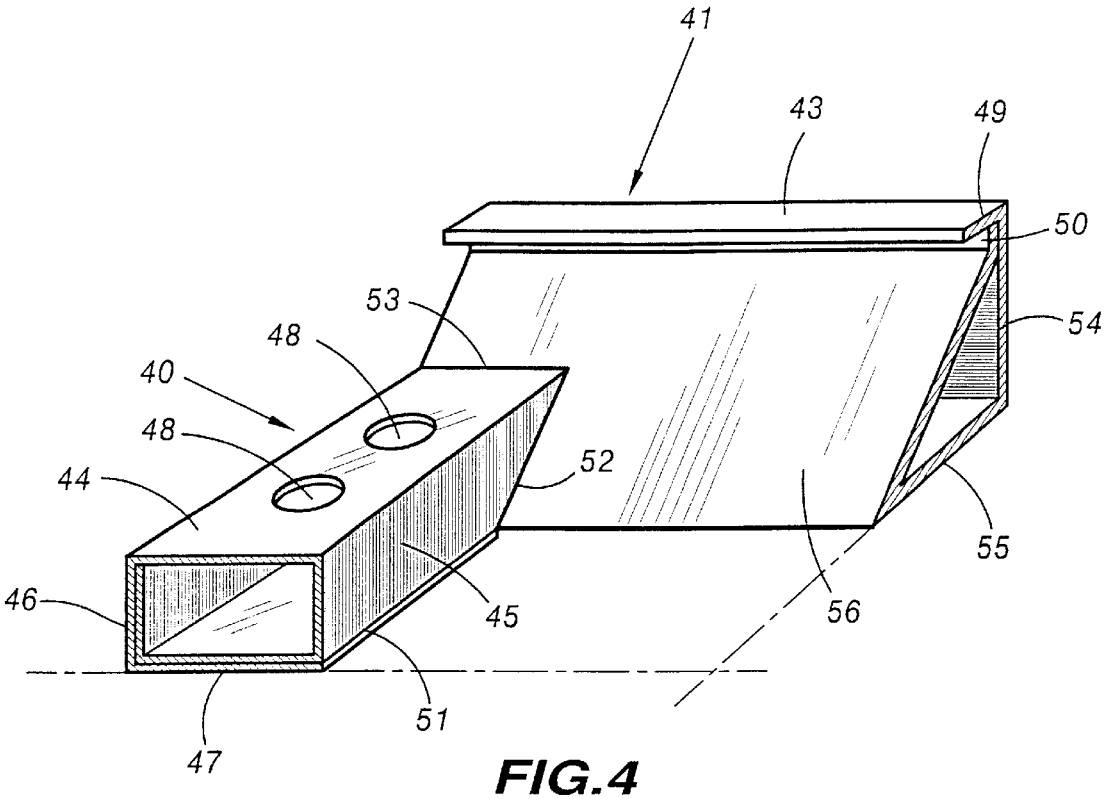
FIG. 4 is a partial perspective view of a variation of the shadow mask support frame shown in FIG. 3.

As may be seen in FIG. 4, each lateral upstand 40 is obtained by folding a strip in such a way that two walls 44 and 45 are of single thickness and two walls 46 and 47 are of double thickness so as to increase the rigidity of the assembly. The single-thickness wall 44 may include openings 48 allowing the introduction of welding means for fastening together the two thicknesses of the wall 47 by welding.

It should be noted that the openings 48 are not essential and that it is possible to produce a weld along the arris 51, at the junction of the faces 45 and 47 of the lateral upstand 40, either by laser welding from the outside, for example by means of a laser weld along a continuous line, or by a plurality of laser spot welds distributed along the double-thickness wall 47.

As may also be seen in FIG. 4, the end upstand 41 is obtained by folding a strip whose edges are bent back so as to form flaps 49 and 50 which fit together, one inside the other, so as to form the upper arris 43 intended to house the shadow mask. The assembly is fastened together by a weld along the flap 50.

The frame thus constructed forms an almost continuous hollow body comprising end and lateral upstands whose lower faces lie in the same plane.

Figure 5:
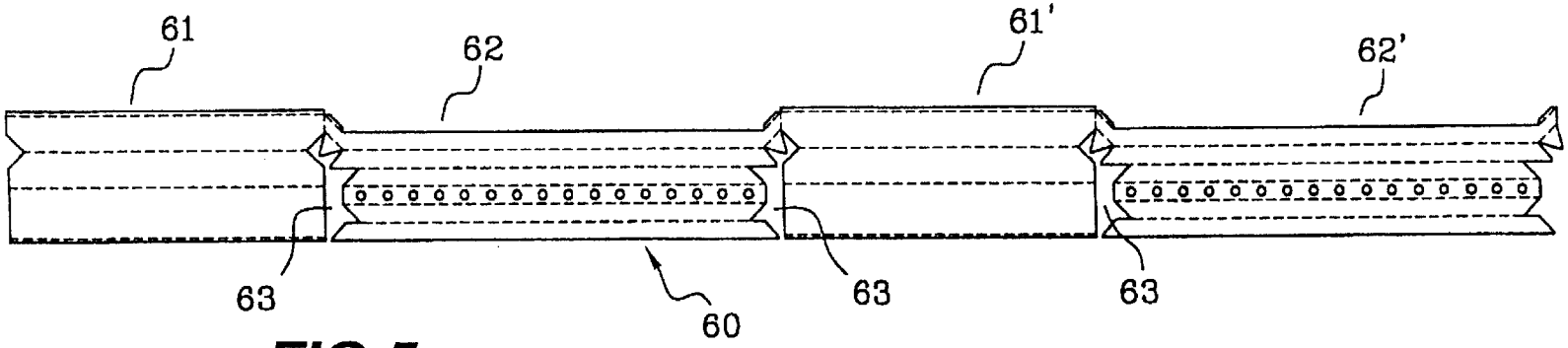
FIG. 5 is a front view of a metal strip which comprises four panels separated by cut-outs and is intended for the manufacture of a shadow mask support frame consisting of a single folded metal strip, as shown in FIGS. 3 and 4.

The frame 39 that has just been described can be produced from a single strip having the developed shape of the frame, shown in FIG. 5. This shape is obtained by opening out the frame at one of its corners, then by unfolding it so as to align all its upstands and then by unfolding the walls of the upstands. The strip thus obtained allows the frame to be reconstructed by folding.

The strip 60 comprises two panels 61, 61' corresponding to the end upstands 41, 41' and two panels 62, 62' corresponding to the lateral upstands 40, 40', arranged alternately. Two successive panels 61 and 62 are separated by a cut-out 63, the shape of which is such that, after folding, the ends of the lateral and end upstands fit together, one inside the other, and such that the corner is broken. The folds are formed along the dotted lines.

Figure 6:
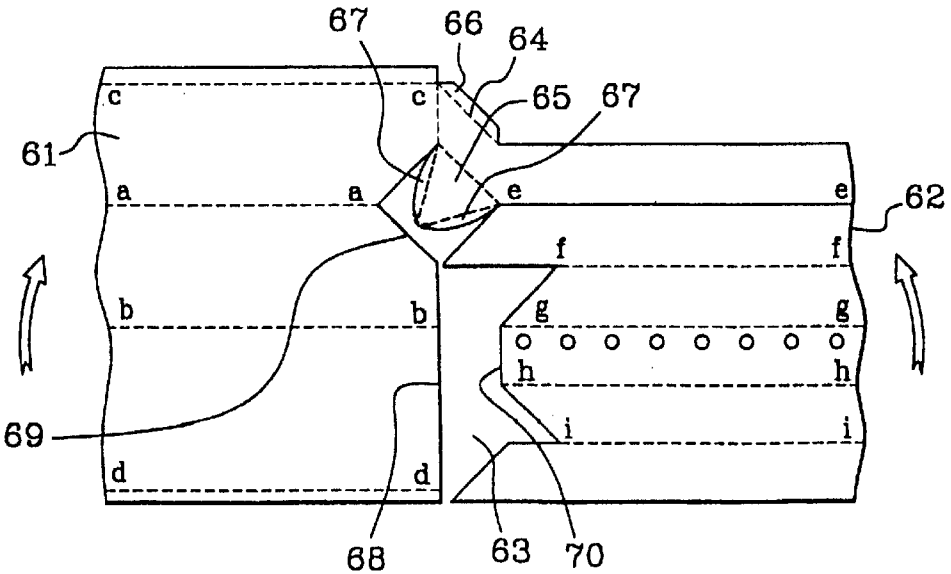
FIG. 6 is an enlarged front view of the cut-out separating two panels of a strip, as shown in FIG. 5, intended to manufacture a shadow mask support frame consisting of a single folded metal strip, as shown in FIGS. 3 and 4.

As may be seen in FIG. 6, the panel 61 corresponding to the end upstand 41 is folded along two main lines aa and bb so as to form the faces 54, 55 and 56 of the end upstand of triangular cross section and along two complementary lines cc and dd in order to form the flaps 49 and 50.

The panel 62 corresponding to the lateral upstand 40 is folded along five lines ee, ff, gg, hh and ii so as to form an upstand of rectangular cross section. The cut-out 63 leaves a small rhombus-shaped strip 64 carrying, on one of its sides, a triangle 65 corresponding to the cut corner 42 of the frame and, on the other side, a flap 66. The triangle 65 also has two flaps 67.

On the side of the panel 61, the cut-out has a straight edge 68 and a triangular indent 69 allowing the cut corner 42 to be formed.

On the side of the panel 62, the cut-out forms a broken line 70 defining projecting and reentrant parts which, after folding, will ensure good connection between the lateral and end upstands.

After folding, the various parts which interact are fastened together by welding, especially along all the arrises, visible from the outside, which do not correspond to folds. This is particularly the case with the arrises 52 and 53, corresponding to the junction between a lateral upstand 40 and an end upstand 41, and with the flap 50.

The shadow mask support frame thus produced forms a continuous hollow body which is very rigid, lightweight and has very good geometrical precision while being easy to manufacture. It also has the advantage of exhibiting very favourable vibration behaviour, particularly because it has excellent damping properties. This frame is particularly suitable for the support of a tensioned shadow mask.

As in the previous embodiment, the shadow mask support frame may be made of a metallic material such as a low-carbon steel, an iron-based alloy, an iron-nickel alloy, an iron-chromium alloy, a nickel-based alloy, a structural-hardening alloy, a martensitic-type-hardening alloy, a magnetic alloy, a non-magnetic alloy or a vibration-damping alloy.

The strip may also be a composite strip, the panels 61 and 61' being made of a first alloy and the panels 62 and 62' being made of a second alloy.

In a preferred variant of the above embodiment, shown especially in FIGS. 7 and 8, the end upstand 80 is of triangular cross section, as in the previous case, and includes, along its upper arris 83, a flap 84 intended to house a shadow mask. However, the inclined wall 81 is joined to the vertical wall 82 precisely along the arris 83, just beneath the flap 84, the assembly being achieved by a plurality of spot welds placed at the bottom of indentures 85 arranged along the edge of the inclined wall 81. These indentures are produced, for example, by drawing before the membrane is folded. This arrangement has the advantage of improving the mechanical strength of the upper arris 83.

The lateral upstand 86 is of square cross section, a single wall 87 of which is of double thickness. The two thicknesses of the wall 87 are fastened together by a plurality of spot welds (not visible in the figure) distributed over the entire length of the lateral upstand. These spot welds are produced, for example, by laser welding from the outside. The welding may also be in the form of a weld seam or a plurality of weld seams.

As may be seen in FIG. 8, the lateral upstand 86 fits into the end upstand 80 and penetrates the inside so that its inner face 93 rests on the lower face 88 of the end upstand, thereby allowing them to be fastened together by laser welding from the outside. The lateral upstand 86 may extend as far as the vertical wall 82 of the end upstand—in this case the hollow body is "almost continuous"—or on the contrary it may stop before touching this wall 82—in this case the hollow body is continuous since no wall prevents a continuous passage from the inside of the lateral upstand to the inside of the end upstand being formed. It may be noted that the length of that part 92 of the lateral upstand which lies inside the end upstand has a strong influence on the rigidity of the assembly and that this rigidity may be adjusted by choosing this length as required.

The end upstand 80 is joined to the lateral upstand 86 by means of flaps 89, 90 and 91 fastened by welding to the walls of the upstand with which they interact. It should be noted that the flap 89 allows the end of the wall 87 of the lateral upstand 86 to be fastened to the inclined wall 81 of the end upstand 80. This is because the wall 87 is extended by a trapezoidal part 87' (partially visible in FIG. 8) which obstructs the end of the end upstand 80. This arrangement has the advantage of improving the rigidity of the end upstand.

It should be noted, as shown in FIGS. 9*a* and 9*b*, that the upper arris 95 of the end upstand 96, intended to house a shadow mask, may be curvilinear, the curve formed by the upper arris 95 lying neither in a vertical plane nor in a horizontal plane. In this case, to allow good connection between the vertical face 97 and the inclined face 98, these two faces include dished regions 99 and 100, forming surfaces which can be joined along the arris 95. These dished regions have a generally domed shape, the concavity of which is preferably oriented towards the inside of the upstand, thereby improving the mechanical behaviour of the latter. The longitudinal upstands 101 and 102 are not modified with respect to the previous embodiment.

In the embodiment that has just been described, the lateral upstands have a square cross section. However, and in order to reduce the shadow effects on the lateral edges of the shadow mask as far as possible, the lateral upstands may have a trapezoidal or triangular cross section. As shown in FIG. 10, the electron gun 105 located beneath the shadow mask support frame 106 emits an electron beam which scans the pyramidal volume represented by the broken lines 107. The end upstand 108 of the shadow mask support frame 106 is of triangular cross section and has an inclined face 109 almost parallel to one face of the pyramidal volume defined by the broken lines 107. The lateral upstand 110 has a trapezoidal cross section, having an inclined face 111 approximately parallel to one face of the pyramidal volume defined by the broken lines 107.

It should also be noted, as shown in FIG. 11, that the end upstand 112 may also have a trapezoidal cross section and have a narrow upper face 113 intended to house the shadow mask.

In the embodiment that has just been described, with its variants, the frame is made from a metal strip suitably cut and then folded so as to form an almost continuous hollow body, having touching parts fastened together by welding.

However, when the dimensions of the frame are not too great, it is possible to produce it from a single piece 115, as shown in FIG. 12*a;* on the other hand, when the frame is very large, the developed length is such that it becomes very difficult to handle a strip of this length. The frame may then be made from several pieces obtained by folding and are subsequently joined together. It is possible, for example, to produce the frame from two pieces 116 and 116', each corresponding to a lateral upstand 117 or 117' and an end upstand 118 or 118'. It is also possible to produce the frame from four pieces corresponding, on the one hand, to the two end upstands 119 and 120 and, on the other hand, to the two lateral upstands 121 and 122.

The embodiments described above are not limiting. Further equivalent forms are possible. In particular, it is possible for the lateral upstands not to comprise double-thickness walls but simply flaps from one wall onto the other so as to make them easier to weld. It may even be possible for there not to be flaps, the welding then being edge to edge. Likewise, the double-thickness wall or walls are not necessarily the outer side walls or the inner walls as indicated in the figures, but any wall that a person skilled in the art may choose, for example depending on the manufacturing conditions in order to make manufacture easier. Likewise, it is possible for the upper arris of an end upstand intended to house a shadow mask not to include a flap, it being possible for the shadow mask to be welded in any suitable manner that a person skilled in the art may choose, depending on the manufacturing means available (for example, seam welding along an arris).

Further alternative embodiments are possible, especially when the frame is manufactured from several parts. For example, as shown in FIG. 15, the end upstands 160 may have lateral-upstand initiators 161, the lateral upstands 162 then being tubes which are fitted into the lateral-upstand initiators or into which the lateral-upstand initiators are fitted.

Likewise, the manufacture of a frame obtained by folding may be achieved by other methods of folding. In particular, it is possible to carry out the folding using a cut blank corresponding to a development of the frame carried out in a different way from that described.

In all the embodiments that have just been described, the lower faces of the lateral upstands and of the end upstands lie approximately in the same plane. With this arrangement, from a structure's mechanical standpoint, the end upstands bear on the ends of the lateral upstands. This characteristic may be obtained in various configurations as shown in FIGS. 13*a,* 13*b,* 13*c*. In the three cases, the upper face 132 of the lateral upstand lies below the upper arris 133 of the end upstand but either the lower face 130 of the end upstand is in the same plane as the lower face 131 of the lateral upstand, or it is below it, or it is above it but below the upper face 132 of the lateral upstand. In all cases, it is possible to define at least one plane P on which it is possible to trace at least one closed curve entirely located inside the hollow body that the frame forms and passing inside each of the upstands. An example of a continuous line is also shown in FIG. 8 in which may be seen the plane P and the line AA' in broken lines. Admittedly, this figure only shows a quarter of the frame, but the reader will understand that by joining the four quarters of the frame together the line AA' is extended in order to form a closed continuous line lying within the plane P and lying inside the four upstands of the frame. In this figure, the lateral upstand 93 is not extended as far as the external wall 82 of the end upstand 80, so that the hollow body is continuous. In an alternative embodiment, the lateral upstand 93 could extend as far as the external wall 82 of the end upstand. In this case, the line AA' would necessarily pass through that part 92 of the lateral upstand 93 which lies inside the end upstand so that the hollow body would not be absolutely continuous but almost continuous since it is locally obstructed by the internal walls. This alternative embodiment illustrates what is meant by an "almost continuous" hollow body.

When it is mounted in a cathode-ray tube, the shadow mask support frame is held in position by fasteners which may be of various shapes, fixed to the frame by welding, clip-fastening or screw-fastening.

The fastener 140 shown in FIG. 14 is fixed to the frame in a corner 141 both by clip-fastening and by screw-fastening. To do this, firstly the fastener 140 has two tabs 144 and 145 and two holes 148 and 149 and secondly the frame has (in each corner intended to house a fastener) two slots 142 and 143 and two holes 150 and 151. The clip-fastening is achieved by inserting the tabs 144 and 145 of the fastener 140 into the slots 142 and 143 and the screw-fastening is achieved by screwing two screws 146 and 147 through the holes 148 and 149 into the holes 150 and 151. In this example, the lower corner 152 of the frame is cut, thereby creating a hole in the wall of the frame. This hole may be used for removing the cleaning liquids used throughout the process of manufacturing the frame. It may also be used for adjusting the deformation of the frame when forces are applied to the two end upstands before the shadow mask is welded. This adjustment may be done by choosing the size of the hole suitably.

What is claimed is:

1. A shadow mask support frame for supporting a shadow mask of a cathode-ray color display tube, the shadow mask support frame being generally rectangular in shape in top plan view, and the shadow mask support frame comprising:

first and second end upstands located opposite each other, wherein each of the first and second end upstands is configured to support an outer edge of the shadow mask; and first and second lateral upstands configured to keep first and second ends of the first and second end upstands separated from each other, each of the first and second end upstands and the first and second lateral upstands being generally tubular in shape and being directly connected to each other to form a closed hollow body containing at least one plane closed line located entirely inside the closed hollow body and passing inside each of the first and second end upstands and the first and second lateral upstands, wherein the first and second end upstands and the first and second lateral upstands are formed from at least one thin sheet of metal which is folded so as to form at least a portion of the closed hollow body of the shadow mask support frame comprising at least one of the first end upstand, the second end upstand, the first lateral upstand, and the second lateral upstand.

2. The shadow mask support frame according to claim 1, wherein the at least one thin sheet of metal is actually a single thin sheet of metal which is folded so as to form the closed hollow body of the shadow mask support frame.

3. The shadow mask support frame according to claim 1, wherein the at least one thin sheet of metal is actually first and second thin sheets of metal folded into a first half-frame and a second half-frame, respectively, the first and second half-frames being joined together to form the closed hollow body of the shadow mask support frame, and each of the first and second half-frames including one of the first and second lateral upstands and one of the first and second end upstands.

4. The shadow mask support frame according to claim 1, wherein the at least one thin sheet of metal is actually first, second, third, and fourth thin sheets of metal; wherein the first and third thin sheets of metal are folded to form the first and second end upstands and the second and fourth thin sheets of metal are folded to form the first and second lateral upstands, the first and second end upstands and the first and second lateral upstand being joined to each other to form the closed hollow body of the shadow mask support frame.

5. The shadow mask support frame according to any one of claims 1, 2, 3, or 4, wherein at least one of the first and second end upstands has a generally triangular cross-section.

6. The shadow mask support frame according to claim 5, wherein the at least one of the first and second end upstands includes, along an upper arris thereof a flap forming a thin strip configured to support the shadow mask.

7. The shadow mask support frame according to claim 6, wherein the at least one of the first and second end upstands comprises, in one of first and second surfaces adjacent to the upper arris, a plurality of indentures arranged along a length of the upper arris and configured to join the first and second surfaces adjacent to the upper arris together by welding.

8. The shadow mask support frame according to claim 7, wherein the upper arris, of the at least one of the first and second end upstands configured to support the shadow mask, is curvilinear.

9. The shadow mask support frame according to claim 8, wherein at least one surface of the first and second surfaces adjacent to the upper arris of the at least one of the first and second end upstands configured to support the shadow mask, includes a dished region so as to allow edges of the first and second surfaces adjacent to the upper arris to interact continuously along the length of the upper arris.

10. The shadow mask support frame according to claim 9, wherein the at least one of the first and second end upstands having the triangular cross-section comprises a face located opposite an inside of the shadow mask support frame and being inclined with respect to a plane of a bottom of the shadow mask support frame.

11. The shadow mask support frame according to any one of claims 1, 2, 3, or 4, wherein at least one end upstand of the first and second end upstands has a generally trapezoidal cross-section and includes an upper face forming a narrow strip which is configured to support the shadow mask.

12. The shadow mask support frame according to claim 10, wherein at least one lateral upstand of the first and second lateral upstands has a generally rectangular cross-section.

13. The shadow mask support frame according to any one of claims 1, 2, 3, or 4, wherein at least one lateral upstand of the first and second lateral upstands has a generally trapezoidal cross-section and includes a face located opposite an inside of the shadow mask support frame and being inclined with respect to a plane of a bottom of the shadow mask support frame.

14. The shadow mask support frame according to claim 12, wherein at least one surface of each of the first and second lateral upstands includes at least two thicknesses of the at least one sheet of metal.

15. The shadow mask support frame according to claim 14, wherein the at least two thicknesses of the at least one sheet of metal are fastened together by either a plurality of spot welds extending along each of the first and second lateral upstands or a weld seam.

16. The shadow mask support frame according to claim 15, wherein the first and second lateral upstands are fitted into the first and second end upstands.

17. The shadow mask support frame according to claim 16, wherein edges of the at least one sheet of metal located adjacent each other to form the at least two thicknesses are fastened together by welding.

18. The shadow mask support frame according to claim 17, wherein the at least one sheet of metal is made of two metallic materials selected from a group of materials consisting of low-carbon steels, iron-based alloys, iron-nickel alloys, iron-chromium alloys, nickel-based alloys, structural-hardening alloys, martensitic-type hardening alloys, magnetic alloys, non-magnetic alloys, and vibration-damping alloys.

19. The shadow mask support frame according to claim 18, wherein the two metallic materials are arranged in such a way that a thermal expansion coefficient of the two metallic materials forming the two lateral upstands is different from a thermal expansion coefficient of the two metallic materials forming the first and second end upstands.

20. The shadow mask support frame according to claim 1, wherein the at least one thin sheet of metal is first and second thin sheets of metal, the first thin sheet of metal forming an external shell and the second thin sheet of metal forming an internal shell, the internal shell being fitted inside of the external shell so as to form the closed hollow body.

21. The shadow mask support frame according to claim 20, wherein at least one shell of the external and internal shells is formed by drawing a thin metal blank which is of generally rectangular shape and which has a rectangular cut-out at a center thereof.

22. The shadow mask support frame according to claim 21, wherein each shell of the external and internal shells is made of at least one metallic material selected from a group consisting of low-carbon steels, iron-based alloys, iron-nickel alloys, iron-chromium alloys, nickel-based alloys, structural-hardening alloys, martensitic-type hardening alloys, magnetic alloys, non-magnetic alloys, and vibration-damping alloys, and wherein the internal shell is either made of a same metallic material as the external shell or made of a metallic material different than the external shell.

23. The shadow mask support frame according to claim 22, wherein at least one shell of the external and internal shells is made of two different metallic materials.

24. The shadow mask support frame according to claim 23, wherein the two end upstands are configured to support the shadow mask in a tensioned manner.

25. Process for manufacturing the shadow mask support frame according to claim 1, wherein the process includes the steps of:

cutting either a strip, having a predetermined shape so as to form a blank of the shadow mask support frame, or a plurality of strips, each strip of the plurality of strips having a predetermined shape to form blanks of a plurality of complementary frame portions of the shadow mask support frame, from a sheet of metallic material;

folding either the strip or the strips along a plurality of lines of the blank or the blanks, respectively, so as to form the shadow mask support frame or the frame portions of the shadow mask support frame, respectively;

fastening together edges of the strip or strips, which are superimposed one with respect to the other, by welding, brazing, or clinching, when the shadow mask support frame is or the frame portions are folded from the blank or blanks; and, when the frame is folded from the blanks, joining the frame portions together by fastening them together by welding, brazing or clinching.

26. Process according to claim 25, wherein the welding is either laser welding or electron-beam welding carried out from outside the shadow mask support frame.

27. A shadow mask support frame for supporting a shadow mask of a cathode-ray color display tube, the shadow mask support frame being generally rectangular in shape in top plan view, and the shadow mask support frame comprising:

first and second end upstands located opposite each other, wherein each of the first and second end upstands is configured to support an outer edge of the shadow mask; and first and second lateral upstands configured to keep first and second ends of the first and second end upstands separated from each other, each of the first and second end upstands and the first and second lateral upstands being generally tubular in shape and being directly connected to each other to form a closed hollow body containing at least one plane closed line located entirely inside the closed hollow body and passing inside each of the first and second end upstands and the first and second lateral upstands, wherein the first and second lateral upstands facing the shadow mask are located at a distance from the surface of the shadow mask supported by the first and second end upstands.

28. The shadow mask support frame according to claim 27, wherein the first and second upstands and the first and second lateral upstands are formed from at least one thin sheet of metal which is folded so as to form at least a portion of the closed hollow body of the shadow mask support frame comprising at least one of the first and second end upstands and of the first and second lateral upstands.

29. The shadow mask support frame according to claim 28, wherein the at least one thin sheet of metal is actually a single thin sheet of metal which is folded so as to form the closed hollow body of the shadow mask support frame.

30. The shadow mask support frame according to claim 28, wherein the at least one thin sheet of metal is actually first and second thin sheets of metal folded into a first half-frame and a second half-frame, respectively, the first and second half-frames being joined together to form the closed hollow body of the shadow mask support frame, and each of the first and second half-frames including one of the first and second lateral upstands and one of the first and second end upstands.

31. The shadow mask support frame according to claim 28, wherein the at least one thin sheet of metal is actually first, second, third, and fourth thin sheets of metal, wherein the first and third thin sheets of metal are folded to form the first and second end upstands and the second and fourth thin sheets of metal are folded to form the first and second lateral upstands, the first and second end upstands and the first and second lateral upstand being joined to each other to form the closed hollow body of the shadow mask support frame.

32. The shadow mask support frame according to any one of claims 27 to 31, wherein at least one of the first and second end upstands has a generally triangular cross-section.

33. The shadow mask support frame according to claim 32, wherein the at least one of the first and second end upstands includes, along an upper arris thereof, a flap forming a thin strip configured to support the shadow mask.

34. The shadow mask support frame according to claim 33, wherein the at least one of the first and second end upstands comprises, in one of first and second surfaces adjacent to the upper arris, a plurality of indentures arranged along a length of the upper arris and configured to join the first and second surfaces adjacent to the upper arris together by welding.

35. The shadow mask support frame according to claim 34, wherein the upper arris, of the at least one of the first and second end upstands configured to support the shadow mask, is curvilinear.

36. The shadow mask support frame according to claim 35, wherein at least one surface of the first and second surfaces adjacent to the upper arris of the at least one of the first and second end upstands configured to support the shadow mask, includes a dished region so as to allow edges of the first and second surfaces adjacent to the upper arris to interact continuously along the length of the upper arris.

37. The shadow mask support frame according to claim 36, wherein the at least one of the first and second end upstands having the triangular cross-section comprises a face located opposite an inside of the shadow mask support frame and being inclined with respect to a plane of a bottom of the shadow mask support frame.

38. The shadow mask support frame according to any one of claims 27 to 31, wherein at least one end upstand of the first and second end upstands has a generally trapezoidal cross-section and includes an upper face forming a narrow strip which is configured to support the shadow mask.

39. The shadow mask support frame according to claim 37, wherein at least one lateral upstand of the first and second lateral upstands has a generally rectangular cross-section.

40. The shadow mask support frame according to any one of claims 27 to 31, wherein at least one lateral upstand of the first and second lateral upstands has a generally trapezoidal cross-section and includes a face located opposite an inside of the shadow mask support frame and being inclined with respect to a plane of a bottom of the shadow mask support frame.

41. The shadow mask support frame according to claim 39, wherein at least one surface of each of the first and second lateral upstands includes at least two thicknesses of the at least one sheet of metal.

42. The shadow mask support frame according to claim 41, wherein the at least two thicknesses of the at least one sheet of metal are fastened together by either a plurality of spot welds extending along each of the first and second lateral upstands or a weld seam.

43. The shadow mask support frame according to claim 42, wherein the first and second lateral upstands are fitted into the first and second end upstands.

44. The shadow mask support frame according to claim 43, wherein edges of the at least one sheet of metal located adjacent each other to form the at least two thicknesses are fastened together by welding.

45. The shadow mask support frame according to claim 44, wherein the at least one sheet of metal is made of two metallic materials selected from a group of materials consisting of low-carbon steels, iron-based alloys, iron-nickel alloys, iron-chromium alloys, nickel-based alloys, structural-hardening alloys, martensitic-type hardening alloys, magnetic alloys, non-magnetic alloys, and vibration-damping alloys.

46. The shadow mask support frame according to claim 45, wherein the two metallic materials are arranged in such a way that a thermal expansion coefficient of the two metallic materials forming the two lateral upstands is different from a thermal expansion coefficient of the two metallic materials forming the first and second end upstands.

47. The shadow mask support frame according to claim 27, wherein the at least one thin sheet of metal is first and second thin sheets of metal, the first thin sheet of metal forming an external shell and the second thin sheet of metal forming an internal shell, the internal shell being fitted inside of the external shell so as to form the closed hollow body.

48. The shadow mask support frame according to claim 47, wherein at least one shell of the external and internal shells is formed by drawing a thin metal blank which is of generally rectangular shape and which has a rectangular cut-out at a center thereof.

49. The shadow mask support frame according to claim 48, wherein each shell of the external and internal shells is made of at least one metallic material selected from a group consisting of low-carbon steels, iron-based alloys, iron-nickel alloys, iron-chromium alloys, nickel-based alloys, structural-hardening alloys, martensitic-type hardening alloys, magnetic alloys, non-magnetic alloys, and vibration-damping alloys, and wherein the internal shell is either made of a same metallic material as the external shell or made of a metallic material different than the external shell.

50. The shadow mask support frame according to claim 49, wherein at least one shell of the external and internal shells is made of two different metallic materials.

51. The shadow mask support frame according to claim 50, wherein the two end upstands are configured to support the shadow mask in a tensioned manner.

52. Process for manufacturing the shadow mask support frame according to claim 27, wherein the process includes the steps of:

cutting either a strip, having a predetermined shape so as to form a blank of the shadow mask support frame, or a plurality of strips, each strip of the plurality of strips having a predetermined shape to form blanks of a plurality of complementary frame portions of the shadow mask support frame, from a sheet of metallic material;

folding either the strip or the strips along a plurality of lines of the blank or the blanks, respectively, so as to form the shadow mask support frame or the frame portions of the shadow mask support frame, respectively;

fastening together edges of the strip or strips, which are superimposed one with respect to the other, by welding, brazing, or clinching, when the shadow mask support frame is or the frame portions are folded from the blank or blanks; and, when the frame is folded from the blanks, joining the frame portions together by fastening them together by welding, brazing or clinching.

53. Process according to claim 52, wherein the welding is either laser welding or electron-beam welding carried out from outside the shadow mask support frame.

* * * * *